US012673804B2

(12) United States Patent
Hilger et al.

(10) Patent No.: US 12,673,804 B2
(45) Date of Patent: Jul. 7, 2026

(54) REUSABLE AND RECYCLEABLE NESTING PALLET

(71) Applicant: White Rabbit LLC, Milwaukee, WI (US)

(72) Inventors: Richard L. Hilger, Milwaukee, WI (US); David Wegner, Richfield, WI (US)

(73) Assignee: WHITE RABBIT LLC, Milwaukee, WI (US)

( * ) Notice: Subject to any disclaimer, the term of this patent is extended or adjusted under 35 U.S.C. 154(b) by 142 days.

(21) Appl. No.: 18/507,501

(22) Filed: Nov. 13, 2023

(65) Prior Publication Data

US 2025/0153897 A1 May 15, 2025

(51) Int. Cl.
*B65D 19/00* (2006.01)
*B65D 65/38* (2006.01)

(52) U.S. Cl.
CPC ..... *B65D 19/0097* (2013.01); *B65D 65/38* (2013.01); *B65D 2519/00019* (2013.01); *B65D 2519/00034* (2013.01); *B65D 2519/00044* (2013.01); *B65D 2519/00054* (2013.01); *B65D 2519/00069* (2013.01); *B65D 2519/00273* (2013.01); *B65D 2519/00293* (2013.01); *B65D 2519/00323* (2013.01); *B65D 2519/00338* (2013.01); *B65D 2519/00562* (2013.01); *B65D 2519/0094* (2013.01); *B65D 2565/384* (2013.01); *B65D 2565/385* (2013.01)

(58) Field of Classification Search
CPC ..... B65D 19/0097; B65D 65/38; B65D 2519/00019; B65D 2519/00054; B65D 2519/00034; B65D 2519/00044; B65D 2519/00079; B65D 19/0026
USPC ..... 206/599, 386; 108/51.3
See application file for complete search history.

(56) References Cited

U.S. PATENT DOCUMENTS

| | | | | |
|---|---|---|---|---|
| 3,141,422 | A | 7/1964 | Woolworth | |
| 5,669,315 | A | 9/1997 | Model | |
| 5,964,162 | A | 10/1999 | Chuan-Jen | |
| 5,996,509 | A | 12/1999 | Lai | |
| 6,026,754 | A * | 2/2000 | Kohlhaas | B65D 19/0028 108/56.3 |
| 6,997,113 | B1 | 2/2006 | Harding et al. | |
| 10,486,853 | B1 * | 11/2019 | Schopke | B65D 19/0071 |
| 2003/0000432 | A1 * | 1/2003 | Crevillen Pastor | B65D 19/0028 108/51.3 |
| 2005/0193926 | A1 | 9/2005 | Cassidy et al. | |
| 2007/0181045 | A1 | 8/2007 | Smyers | |

(Continued)

*Primary Examiner* — Rafael A Ortiz
(74) *Attorney, Agent, or Firm* — Andrus Intellectual Property Law, LLP

(57) ABSTRACT

A pallet having a first corrugated sheet with a plurality of first apertures, a second corrugated sheet with a plurality of second apertures, and a plurality of feet provided as separate components is disclosed. Each of the plurality of feet engage the first corrugated sheet such that each of the first apertures of the first corrugated sheet corresponds to an opening of a cavity for one of the plurality of feet. The second corrugated sheet is placed over the plurality of feet such that each of the plurality of feet extend through the plurality of second apertures. The first corrugated sheet is attached to the second corrugated sheet to secure the plurality of feet between the first corrugated sheet and the second corrugated sheet to form the pallet.

23 Claims, 7 Drawing Sheets

(56) References Cited

U.S. PATENT DOCUMENTS

| | | | | |
|---|---|---|---|---|
| 2008/0202672 | A1* | 8/2008 | Bradford | E04C 2/20 428/116 |
| 2008/0210138 | A1* | 9/2008 | Ishibashi | B65D 19/0012 108/51.3 |
| 2012/0312201 | A1* | 12/2012 | Love | B65D 19/0008 108/57.33 |

* cited by examiner

REUSABLE AND RECYCLEABLE NESTING PALLET

FIELD

The present invention generally relates to pallets.

BACKGROUND

Pallets are often used for shipping goods in order to provide a stable platform for supporting the goods shipped and to provide a stable platform to be engaged by material handling machines such as forklifts. Historically, wood pallets have generally served this purpose. However, such wood pallets have a number of drawbacks-they are relatively expensive to produce and heavy. Wood pallets also typically have a rough, splintery finish and may be prone to cracking, warping or the like.

In addition, heavy pallets may increase shipping costs, which typically may be based on weight. Moreover, the bulk of wood pallets makes them inconvenient to store and return ship. Wooden pallets may not be readily recyclable, as the grades of lumber used may be unsuitable for other purposes or for conversion into paper or the like. Further, the presence of nails or staples in wooden pallets may make them more difficult to recycle, as the wooden pallet is not composed of a homogenous material. Thus, it has been a long felt need to provide a pallet which is lightweight, inexpensive, readily stackable (nestable), strong, has smooth outward surfaces, and is recyclable.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The pallet of the present application is sustainable, recyclable, and functional for forklift operators. The pallet of the present application has a modular design for variable size requirements and is nestable for cost effective shipping/warehousing. The pallet's flat corrugated platform design provides uniform and stable part/pallet pack-outs. The corrugated platform may be constructed from corrugated plastic, corrugated cardboard, or other corrugated material. In one embodiment the corrugated platform is constructed from corrugated recycled plastic.

In one embodiment, the pallet of the present application includes a first corrugated sheet having a top surface, a corresponding a bottom surface, and a plurality of first apertures extending through the top surface to the bottom surface. A second corrugated sheet having a top surface, a corresponding a bottom surface, and a plurality of second apertures extending through the top surface to the bottom surface, and a plurality of feet provided as separate components are also provided. The plurality of feet have a cavity and a bottom surface, and the cavity has an opening extending to the bottom surface. The plurality of feet engage the bottom surface of the first corrugated sheet such that each of the first apertures of the first corrugated sheet corresponds to the opening of a cavity for one of the plurality of feet. The second corrugated sheet is placed over the plurality of feet such that each of the plurality of feet extend through the plurality of second apertures in the second corrugated sheet with each bottom surface of the feet spaced from the second corrugated sheet. The first corrugated sheet is attached to the second corrugated sheet to secure the plurality of feet between the first corrugated sheet and the second corrugated sheet to form the pallet. The plurality of first apertures of the first corrugated sheet have a shape and size substantially the same as said plurality of feet so as to accept a foot from an adjacent pallet in a nesting fashion. Each of the plurality of feet may be formed into one of: a frustoconical shape, a cylindrical shape, a bilobal columnar shape, or a multifoil columnar shape.

In certain embodiments, the first corrugated sheet may be constructed of cardboard and includes at least one flap configured to be attached to the bottom surface of the second corrugated sheet to secure the plurality of feet between the first corrugated sheet and the second corrugated sheet. In other embodiments, the first corrugated sheet is a quadrilateral and includes four flaps located along each side of the first corrugated sheet. Each flap includes a top score located at a junction between the top surface and the side flap, and a bottom score located outwardly from and parallel to the top score. A securing flap portion is located outwardly of the bottom score. Each of the flaps tapers inwardly from a first top score at each of a first end and second end of the respective side flaps. The flaps are bent at least ninety degrees from parallel along the top scores and also bent along the bottom scores to define side surfaces of pallet. The respective securing flap portions attach to the bottom surface to the second corrugated sheet to secure the plurality of feet between the first corrugated sheet and the second corrugated sheet.

The securing flap portions may attach to the bottom surface of the second corrugated sheet through an adhesive substance. The adhesive substance may be selected from one of: animal glue, casein glue, serum albumen glue, starch glue, dextrin glue, agar, algin, gum arabic, nitrocellulose resin, polyvinyl acetate resin, vinyl acetate-ethylene copolymer resin, polyethylene resin, polypropylene resin, polyamide resin, polyester resin, acrylic resin, cyanoacrylic resin, phenol formaldehyde, urea formaldehyde, unsaturated polyesters, epoxy, and polyurethane, natural rubber, butyl rubber, butadiene rubber, styrene-butadiene rubber, nitrile rubber, silicone, and neoprene, and wherein the first corrugated sheet and the second corrugated sheet comprises double-lined corrugated paperboard.

In certain embodiments, the first corrugated sheet is plastic and is secured to the second corrugated sheet to secure the plurality of feet between the first corrugated sheet and the second corrugated sheet. The plastic may be recycled corrugated plastic. The second corrugated sheet may also be plastic. The first corrugated sheet may be secured to the second corrugated sheet along a score line, and the first corrugated sheet may be folded onto the top of the second corrugated sheet along the score line to secure the plurality of feet between the first plastic corrugated sheet and the second plastic corrugated sheet. When the first corrugated sheet and the second corrugated sheet are plastic, the first corrugated sheet may be secured to the second corrugated sheet though heat sealing or sonic welding.

In other embodiments, the pallet of the present application has a first corrugated sheet comprising a top surface having a length and a width, and a corresponding a bottom surface.

A plurality of first apertures extend through the top surface to the bottom surface. Four side flaps are located along each side of the length and width of the first corrugated sheet, with each side flap including a top score located at a junction between the top surface and the side flap and extending the length or width of the top surface. A bottom score is located outwardly from and parallel to the top score, and a securing flap portion is located outwardly of the bottom score. A plurality of feet are provided as separate molded components. The plurality of feet have a planar top surface with a cavity and an opposing planar bottom surface. The cavity has an opening located in the planar top surface, the cavity extending along a side surface to the bottom surface. The side surface has an inner side cavity surface extending from the opening and an outer side foot surface extending from the planar bottom surface. The bottom of each of the plurality of feet have an inner cavity bottom and an outer foot bottom. A second corrugated sheet having a top surface having a length and a width, a corresponding a bottom surface, and a plurality of second apertures extending through the top surface to the bottom surface is placed over the plurality of feet such that each of the outer side foot surface and the outer foot bottom of each of the plurality of feet extend through the plurality of second apertures in the second corrugated sheet and the top surface of the second corrugated sheet.

In this embodiment, the planar top surfaces of each of the plurality of feet engage the bottom surface of the first corrugated sheet such that each of the first apertures of the first corrugated sheet corresponds to the opening of a cavity for one of the plurality of feet. Also, the second corrugated sheet engages the planar bottom surface of each of the respective plurality of feet such that each outer foot bottom is spaced from the second corrugated sheet. The side flaps are bent at least ninety degrees from parallel along the top scores and also bent along the bottom scores to define side surfaces of pallet. The respective securing flap portions attach to the bottom surface to the second corrugated sheet to secure the plurality of feet between the first corrugated sheet and the second corrugated sheet to form the pallet.

In certain embodiments, the plurality of feet float freely between the first corrugated sheet and the second corrugated sheet. In other embodiments, the plurality of feet are adhered to the bottom surface of the first corrugated sheet. The plurality of feet may further include at least three downwardly and outwardly extending protrusions from the opening and the side surfaces, and wherein the plurality of apertures in the second corrugated sheet are shaped such that the downwardly ad outwardly extending protrusions of the plurality of feet extend through the plurality of apertures in the second corrugated sheet.

In certain embodiments, each of the side flaps tapers inwardly from the first top score at each of a first end and second end of the respective side flaps. The securing flap portions may attach to the bottom surface of the second corrugated sheet through an adhesive substance. In this embodiment as well, the adhesive substance may be selected from one of: animal glue, casein glue, serum albumen glue, starch glue, dextrin glue, agar, algin, gum arabic, nitrocellulose resin, polyvinyl acetate resin, vinyl acetate-ethylene copolymer resin, polyethylene resin, polypropylene resin, polyamide resin, polyester resin, acrylic resin, cyanoacrylic resin, phenol formaldehyde, urea formaldehyde, unsaturated polyesters, epoxy, and polyurethane, natural rubber, butyl rubber, butadiene rubber, styrene-butadiene rubber, nitrile rubber, silicone, and neoprene.

In certain embodiments one of or both of the first and second corrugated sheets are double-lined corrugated paperboard. In other embodiments, one of or both of the first and second corrugated sheets are corrugated plastic. In certain embodiments, the corrugated plastic is constructed from recycled plastic. The plurality of first apertures of the first corrugated sheet may have a shape and size substantially the same as said plurality of feet so as to accept a foot from an adjacent pallet in a nesting fashion. The size and shape of the opening of the cavity in each of the respective plurality of feet may match a size and shape of the plurality of apertures in the first corrugated sheet. In other embodiments, the size and shape of the opening of the cavity in each of the respective plurality of feet is greater than a size and shape of the plurality of apertures in the first corrugated sheet. Again, the plurality of feet may be formed into one of: a frustoconical shape, a cylindrical shape, a bilobal columnar shape, or a multifoil columnar shape.

The present application also discloses a recyclable pallet foot formed from scrap pieces of recyclable material. The pallet foot may be composed of shredded fibrous scrap recyclable material, and molded, using a wet pulp process, into a substantially hollow columnar shape. The pallet foot may also be composed of plastic material, and molded into a substantially hollow columnar shape. The plastic material maybe recycled plastic material. The open columnar shape may have an open cavity with an opening, the cavity extending to a planar lower surface. The pallet foot may include planar extensions extending outwardly from the opening for attaching to a substantially planar deck portion of a pallet so as to contact a periphery of one of a plurality of apertures in the substantially planar deck portion. The recyclable pallet foot may be formed into one of: a frustoconical shape, a cylindrical shape, a bilobal columnar shape, or a multifoil columnar shape. The recyclable pallet foot may further include at least three downwardly and outwardly extending protrusions from the opening and the side surfaces. In certain embodiments, the size and shape of the opening in each of the respective plurality of feet is greater than a size and shape of the plurality of apertures in the substantially planar deck portion.

These and still other advantages of the invention will be apparent from the detailed description and drawings. Various other features, objects, and advantages will be made apparent from the following description taken together with the drawings. What follows is merely a description of some preferred embodiments of the present invention. To assess the full scope of the invention, the claims should be looked to as these preferred embodiments are not intended to be the only embodiments within the scope of the claims.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
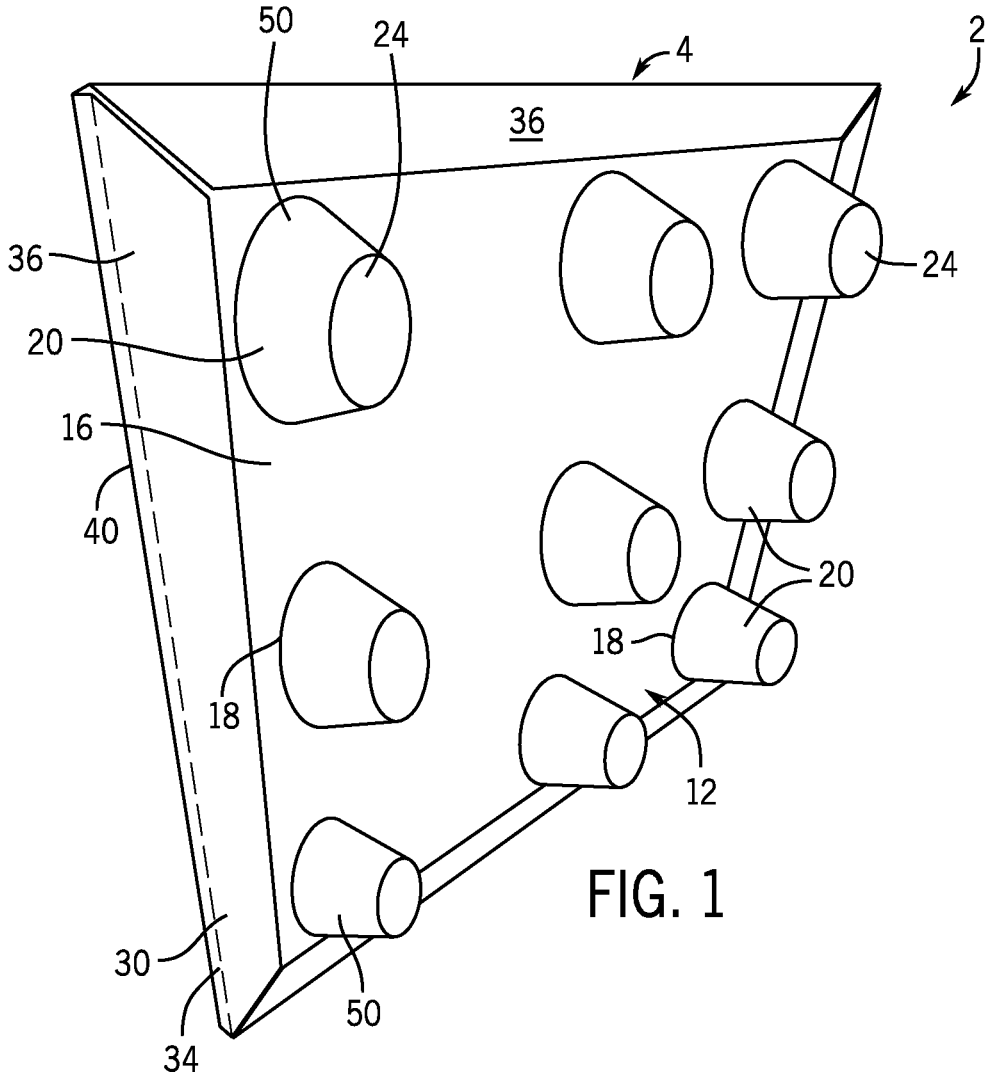
FIG. 1 is a perspective bottom view of a pallet according to the present disclosure.
Figure 2:
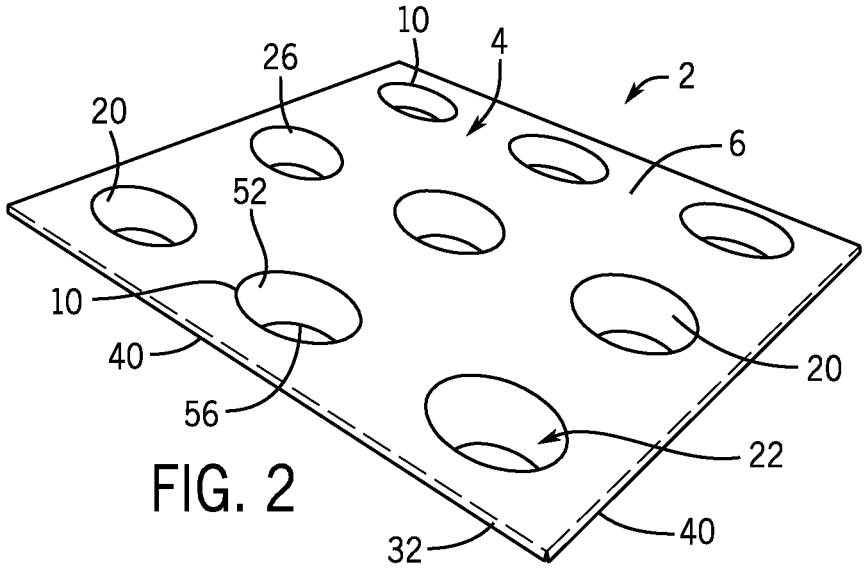
FIG. 2 is a perspective top view of the pallet of FIG. 1.
Figure 3:
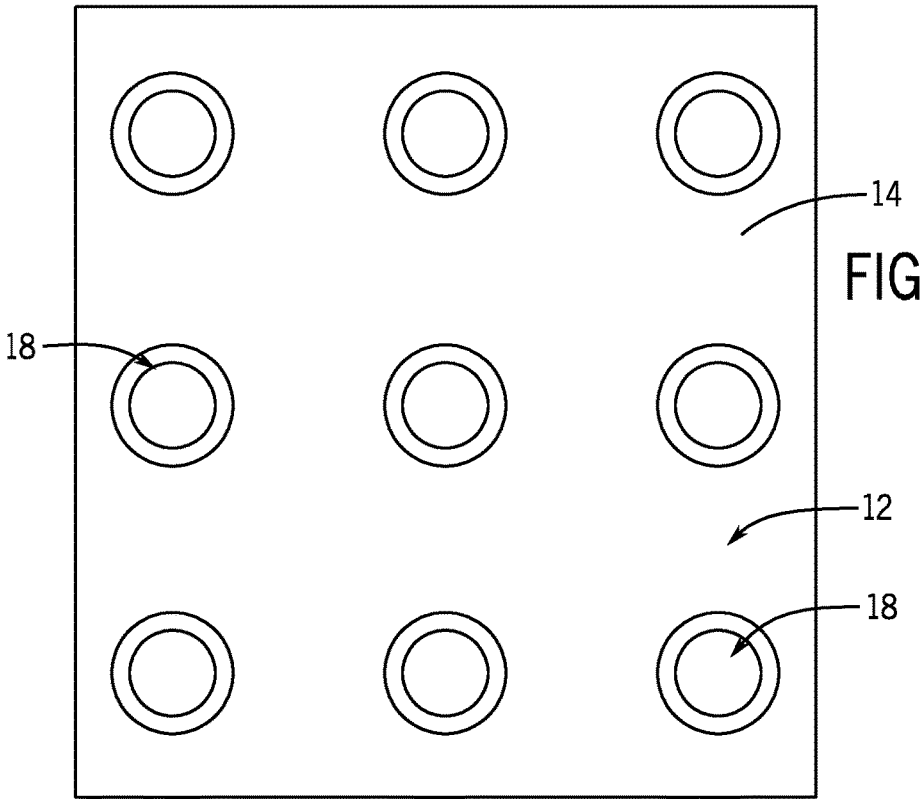
FIG. 3 is a top view of a second corrugated sheet used for constructing the pallet of FIGS. 1-2.

Pallets 2, 102 of the present application are sustainable, recyclable, and functional for forklift operators. The pallets 2, 102 of the present application have a modular design for variable size requirements, and are nestable for cost effective shipping/warehousing. The pallets' flat corrugated platform design provides uniform and stable part/pallet pack-outs.

Turning now to FIGS. 1-4, a first embodiment of a pallet 2 in accordance with the present disclosure is demonstrated. The pallet 2 includes a first corrugated sheet 4 (FIG. 4) having a top surface 6, and a corresponding a bottom surface 8. A plurality of first apertures 10 extend through the top surface 6 to the bottom surface 8. A second corrugated sheet 12 (FIG. 3) having a top surface 14, a corresponding a bottom surface 16, and a plurality of second apertures 18 extending through the top surface 14 to the bottom surface 16 is also provided. The first and second corrugated sheets 4, 12 may be constructed from corrugated plastic, corrugated cardboard, or other corrugated material. In one embodiment the corrugated sheets 4, 12 are constructed from corrugated recycled plastic. One advantageous corrugated plastic board or sheet is the CON-PEARL® product available form Con-Pearl GMBH, of Geismar, Germany. In other embodiments, the corrugated sheets 4, 12 are constructed from conventional corrugated cardboard.

A plurality of feet 20 are provided as separate components. The plurality of feet 20 have a cavity 22 and at least one bottom surface 24 of a foot 20. The cavity 22 has an opening 26 extending to the at least one bottom surface 24 of a foot 20. The plurality of feet 20 engage the bottom surface 8 of the first corrugated sheet 4 such that each of the first apertures 10 of the first corrugated sheet 4 corresponds to the opening 26 of a cavity 22 for one of the plurality of feet 20. The second corrugated sheet 12 is placed over the plurality of feet 20 after the feet are engaged with the bottom surface 8 of the first corrugated sheet 4 such that each of the plurality of feet 20 extend through the plurality of second apertures 18 in the second corrugated sheet 12, with each bottom surface 24 of a foot 20 spaced from the second corrugated sheet 18. Similar to the first and second corrugated sheets 4, 12 the plurality of feet may be constructed of fibrous material or plastic. In certain embodiments the feet may have nipples or recesses to assist in the nesting and stacking of pallets as will be for fully described herein.

The first corrugated sheet 4 is attached to the bottom surface 16 of the second corrugated sheet 12 to secure the plurality of feet 20 between the first corrugated sheet 4 and the second corrugated sheet 12 to form the pallet 2. As shown in the embodiment FIG. 2, the plurality of first apertures 10 of the first corrugated sheet 4 have a shape and size substantially the same as said plurality of feet 20 so as to accept a foot 20 from an adjacent pallet 2 in a nesting fashion. Each of the plurality of feet 20 may be formed into one of: a frustoconical shape, a cylindrical shape, a bilobal columnar shape, or a multifoil columnar shape. The embodiment of FIGS. 1-4 demonstrates bilobal columnar shaped feet 20 having two bottom surfaces 24 for enhanced stability.

Figure 4:
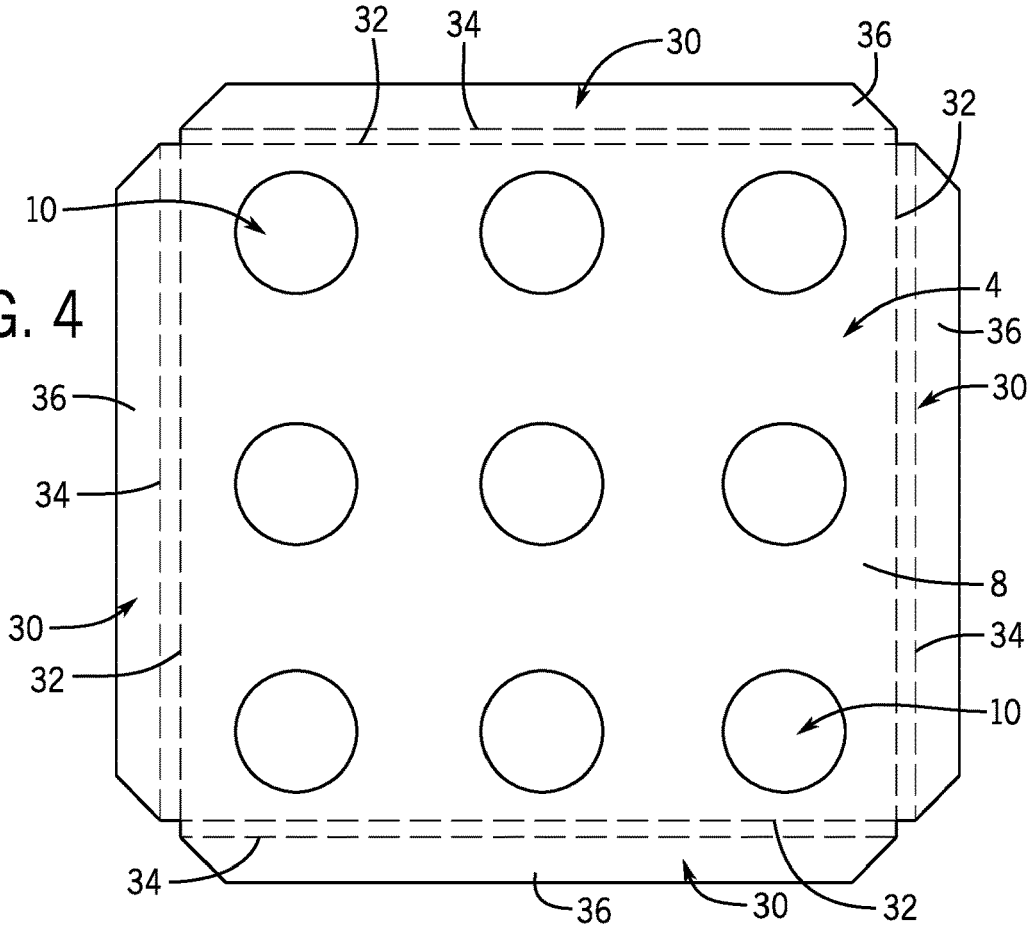
FIG. 4 is a bottom view of a first corrugated sheet used for constructing the pallet of FIGS. 1-2.
Figure 5:
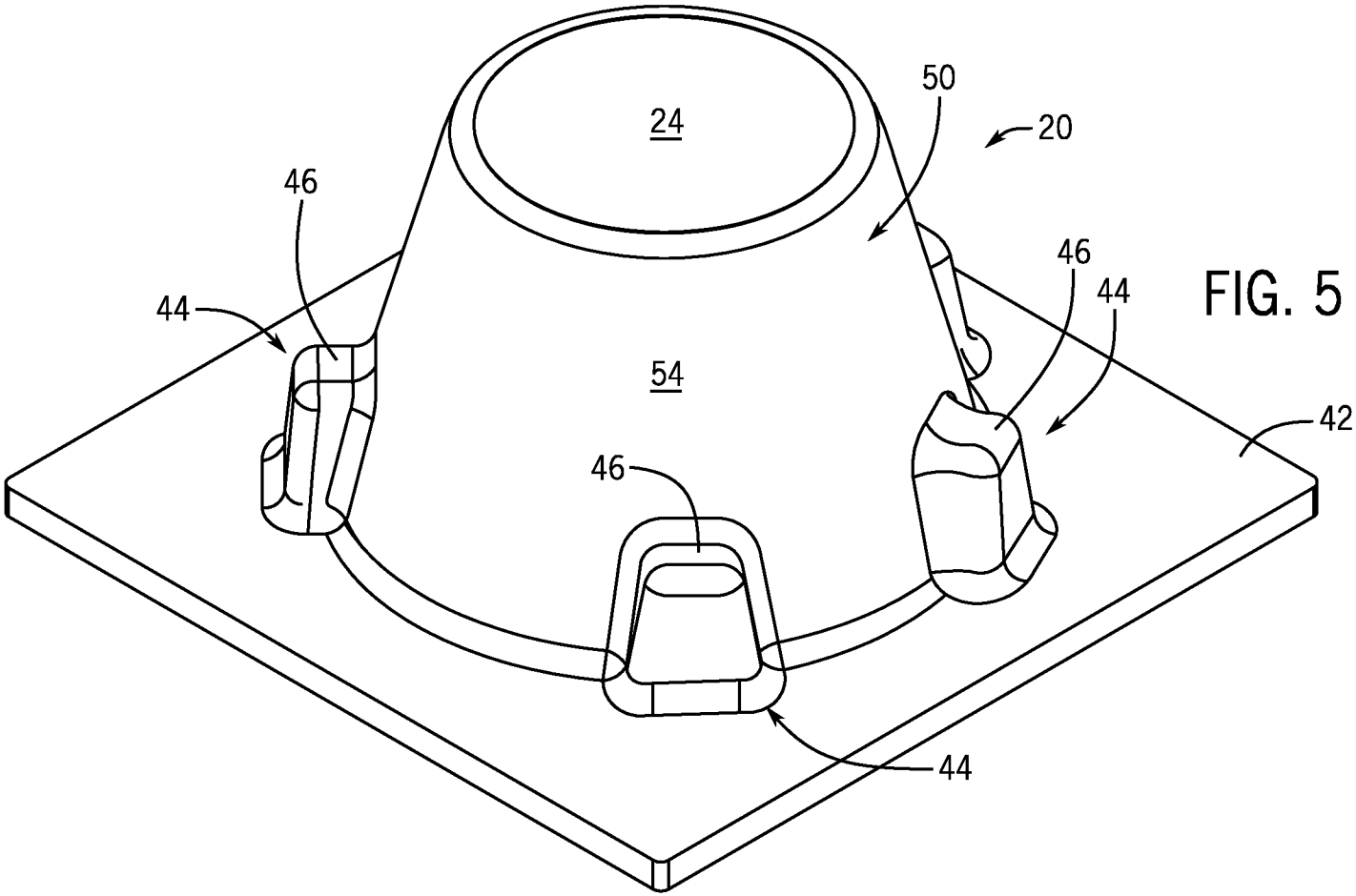
FIG. 5 is a perspective view of a recyclable pallet foot according to the present disclosure.
Figure 6:
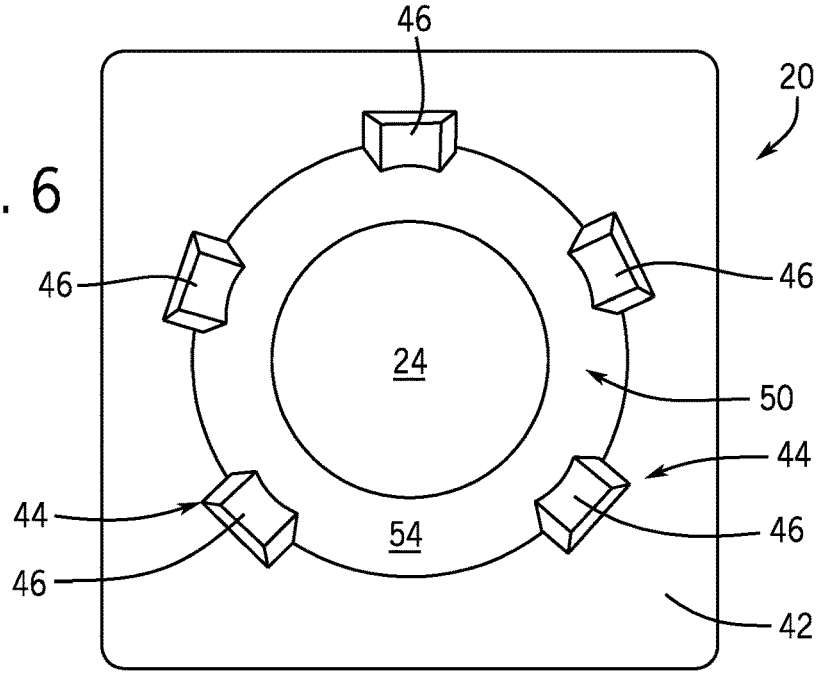
FIG. 6 is a bottom view of the recyclable pallet foot of FIG. 5.
Figure 7:
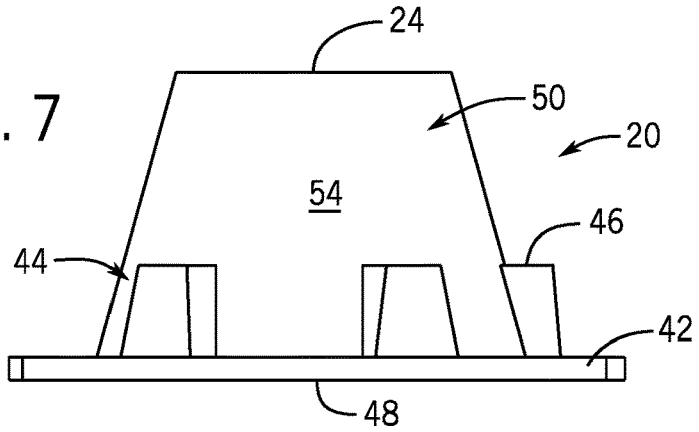
FIG. 7 is right side view of the recyclable pallet foot of FIG. 5.
Figure 8:
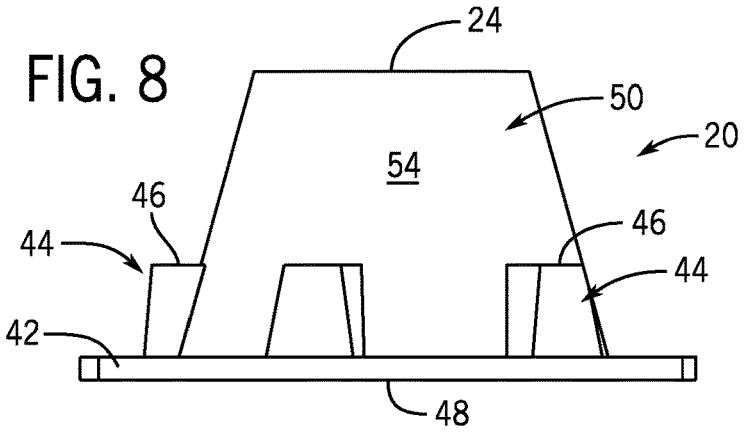
FIG. 8 is a left side view of the recyclable pallet foot of FIG. 5.

Turning now to FIG. 4, the first corrugated sheet 4 may include at least one flap 30 configured to be attached to the bottom surface 16 of the second corrugated sheet 12 to secure the plurality of feet 20 between the first corrugated sheet 4 and the second corrugated sheet 12. In the embodiment of FIGS. 1-4, the first corrugated sheet 4 may be corrugated cardboard and defines a quadrilateral top surface 8 and includes four flaps 30 located along each side of the top surface 8 first corrugated sheet 4. Each flap 30 includes a top score 32 located at a junction between the top surface 8 and the side flap 30, and a bottom score 34 located outwardly from and parallel to the top score 32. A securing flap portion 36 of the side flap 30 is located outwardly from the bottom score 34. Each of the side flaps 30 tapers inwardly from the first top score 32 at each of a first end and second end of the respective side flaps 30. The side flaps 30 are bent at least ninety degrees from parallel along the top scores 32 and also bent along the bottom scores 34 to define side surfaces 40 of pallet 2. The respective securing flap portions 36 attach to the bottom surface 16 to the second corrugated sheet 12 to secure the plurality of feet 20 between the first corrugated sheet 4 and the second corrugated sheet 12 as shown in FIG. 1.

The securing flap portions 36 may attach to the bottom surface 16 of the second corrugated sheet 12 through an adhesive substance. The adhesive substance may be selected from one of: animal glue, casein glue, serum albumen glue, starch glue, dextrin glue, agar, algin, gum arabic, nitrocellulose resin, polyvinyl acetate resin, vinyl acetate-ethylene copolymer resin, polyethylene resin, polypropylene resin, polyamide resin, polyester resin, acrylic resin, cyanoacrylic resin, phenol formaldehyde, urea formaldehyde, unsaturated polyesters, epoxy, and polyurethane, natural rubber, butyl rubber, butadiene rubber, styrene-butadiene rubber, nitrile rubber, silicone, and neoprene. Other adhesive substance are intended to be within the scope of the present disclosure. Alternatively, the securing flap portions 36 may attach to the bottom surface 16 of the second corrugated sheet 12 through staples. The first corrugated sheet 4 and the second corrugated sheet 12 may be constructed of double-lined corrugated paperboard. Other types of corrugated sheets may be used, including by not limited to single face, single wall, single-lined, double wall, double faced, triple wall, or multiple wall configurations.

In other embodiments, the first and second corrugated sheets 4, 12 may be constructed of plastic. In one embodiment, the plastic is a recycled plastic. In this embodiment, flaps 36 are eliminated. The first corrugated sheet 4 is secured to the second corrugated sheet 12 to secure the plurality of feet 20 between the first corrugated sheet 4 and the second corrugated sheet 12. The first corrugated sheet 4 may be separate from the second corrugated sheet 12, and may be secured together though heat sealing or sonic welding at any location where the first corrugated sheet 4 engages the second corrugated sheet 12. In other embodiments, the first corrugated sheet 4 may be secured to the second corrugated sheet 12 along a score line 32, 34, such that the first corrugated sheet 4 may be folded onto the top of the second corrugated sheet 12 along a score line 32, 34 to secure the plurality of feet 24 between the first plastic corrugated sheet 4 and the second plastic corrugated sheet 12. The first corrugated sheet 4 and the second corrugated sheet 12 may then be further to one another though heat sealing or sonic welding at any location where the first corrugated sheet 4 engages the second corrugated sheet 12.

The present application contemplates that the plurality of feet 20 are recyclable pallet feet 20 that are formed from scrap pieces of recyclable material. As such, the recyclable material may be organic or inorganic fibrous materials such as pulp, paper products or cardboard, or a mixture thereof. The recyclable material may also be further blended with other or additional fibrous materials, such as for example, recycled cardboard, recycled newspaper, or other fiber sources like bamboo. As one example, the pallet foot 20 may be composed of shredded fibrous scrap recyclable material, and molded, using a wet pulp process, into a substantially hollow and substantially columnar shape. Alternatively, the recyclable pallet feet 20 tare formed from plastic, including recycled plastic and also formed into a substantially columnar shape. The open columnar shape has an open cavity 22 with an opening 26, the cavity 22 extending to a planar lower surface 24. In the embodiment shown in FIGS. 5-8, the recyclable pallet foot 20 is formed into a frustoconical shape. As noted the feet 20 may take other shapes, including the bilobal columnar shape shown in FIGS. 1-4, or a cylindrical shape, a trilobal columnar shape, or a multifoil columnar shape. As shown in FIG. 5-8, the pallet foot 20 has a planar top surface 48 with a cavity 22 and an opposing planar bottom surface 24. The cavity 22 has an opening 26 (see, e.g. FIG. 2) located in the planar top surface 48, and the cavity 22 extends along a side surface 50 to the bottom surface 24. The side surface 50 has an inner side cavity surface 52 (see, e.g. FIG. 2) extending from the opening 26 and an outer side foot surface 54 extending to the planar bottom surface 24. The bottom of each of the plurality of feet have an inner cavity bottom 56 (FIG. 2) and an outer foot bottom surface 24.

Figure 11:
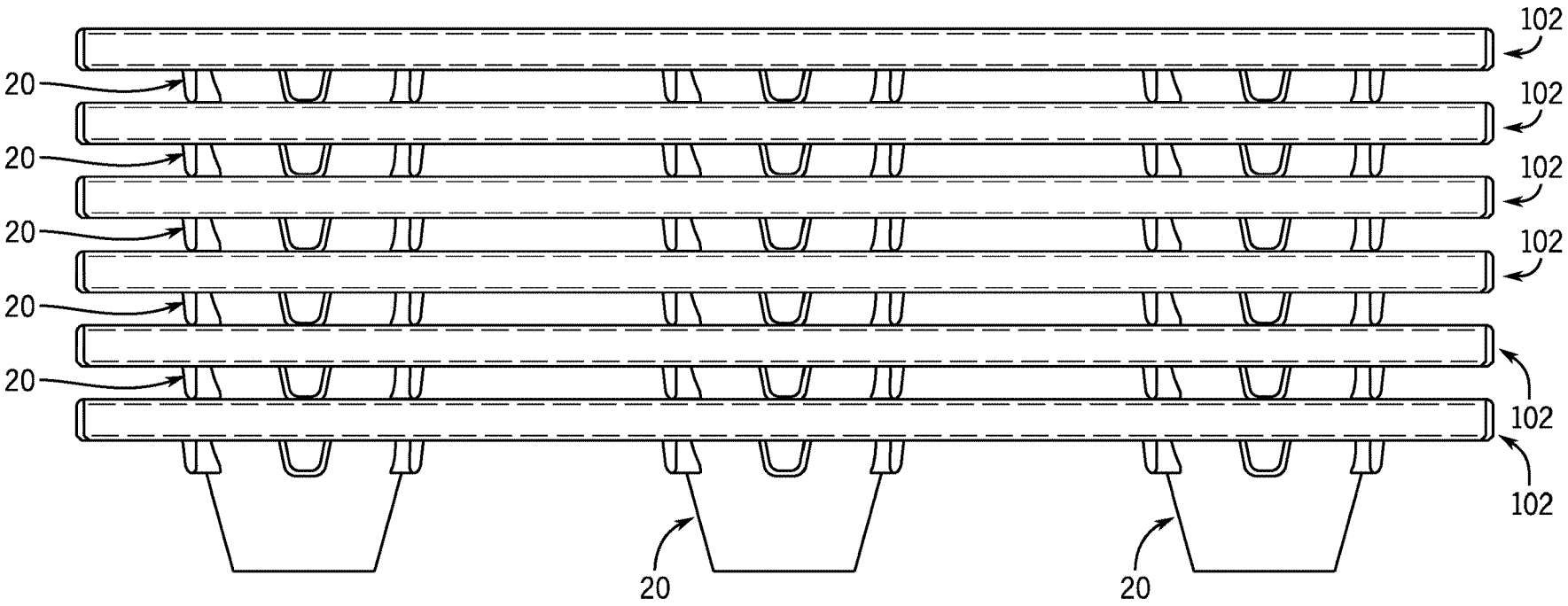
FIG. 11 is a side view of a plurality of assembled pallets nested together in accordance with the present disclosure.

As shown in FIGS. 5-8 and 11, the pallet foot 20 may also include a planar extension or extensions 42 extending outwardly from the opening 26 for attaching to a substantially planar deck portion, e.g. bottom surface 8 of the first corrugated sheet 4, of a pallet 2 so as to contact a periphery of one of a plurality of apertures 10 in the substantially planar deck portion, e.g. 4. The recyclable pallet foot 20 may further include at least three downwardly and outwardly extending protrusions 44. The protrusions 44 may include an engagement surface 46 for engaging the top surface 6, 106 of an adjacent pallet when in a nesting configuration, e.g. as shown in FIG. 11. The size and shape of the opening 26 in each of the respective plurality of feet 20 may be of greater than a size and shape of the plurality of apertures 10 in the substantially planar deck portion, or they may be of comparable size.

Figure 9:
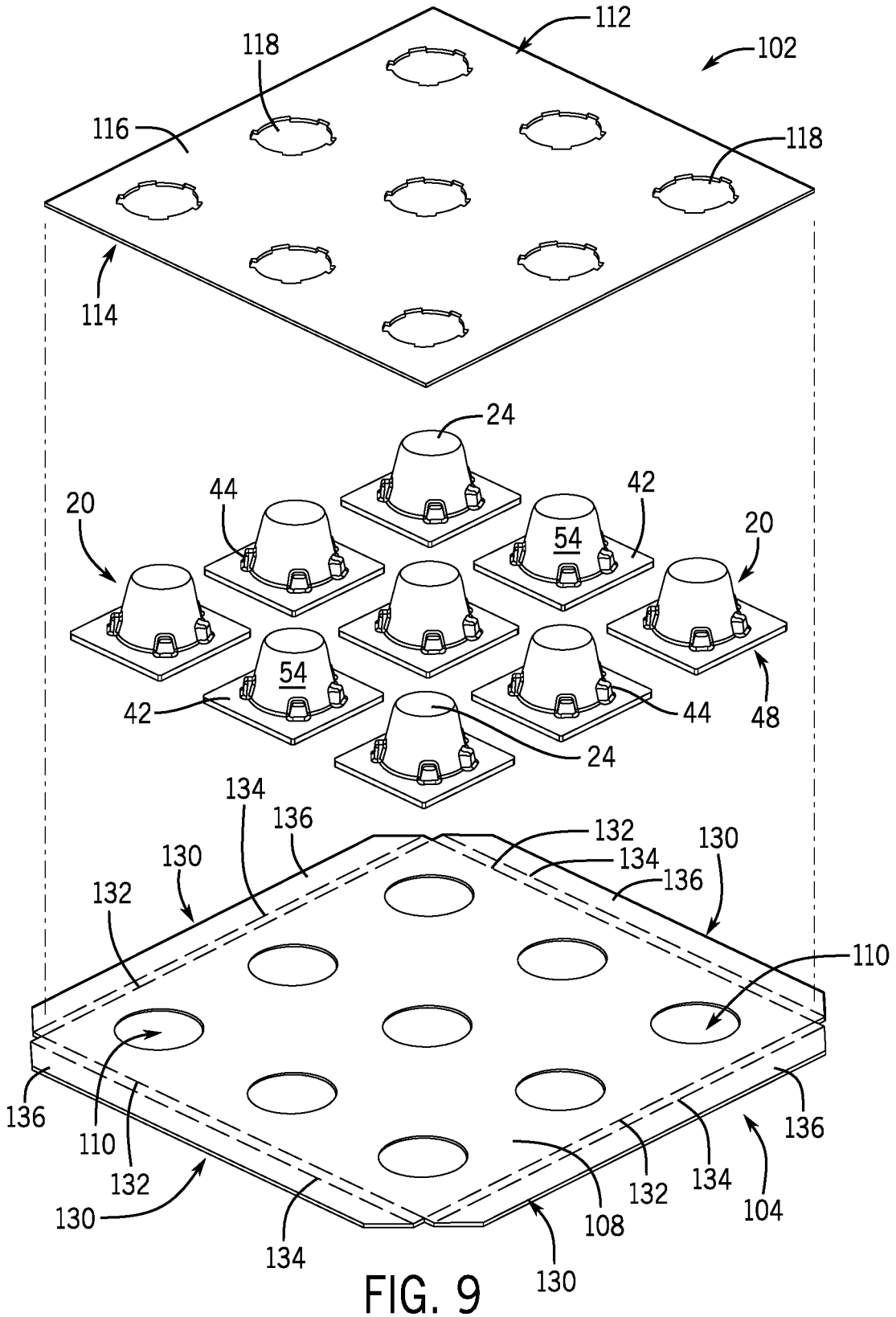
FIG. 9 is an exploded perspective view of a pallet according to the present disclosure.
Figure 10:
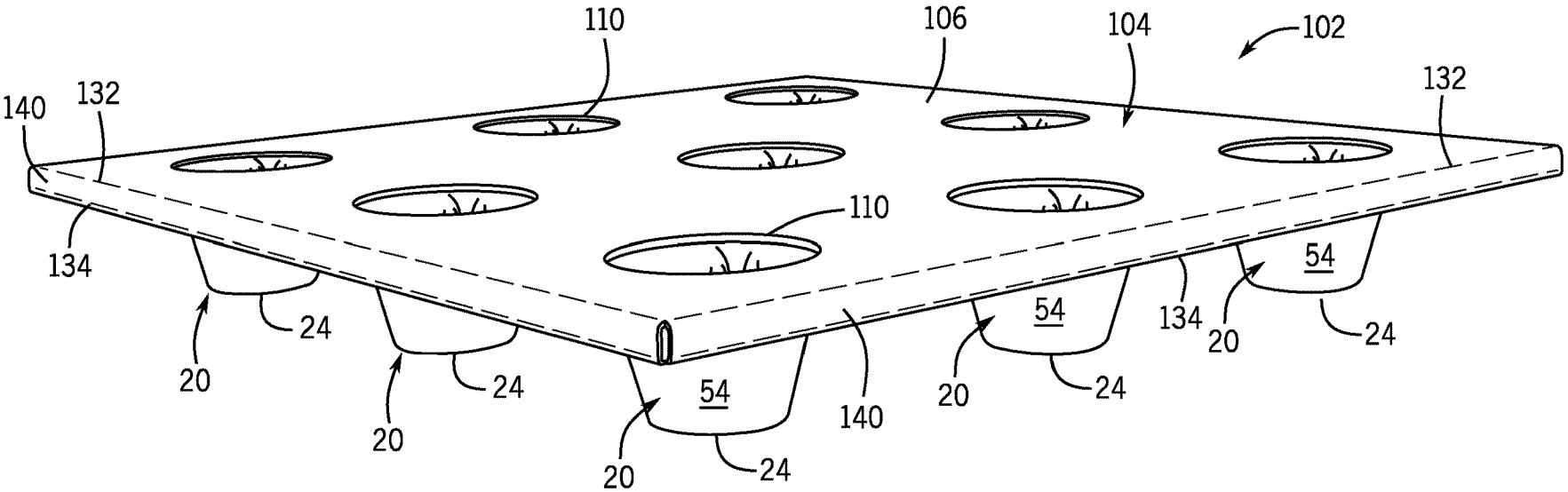
FIG. 10 is a perspective view of an assembled pallet according to the present disclosure.

Another embodiment of a pallet 102 in accordance with the present disclosure is shown in FIGS. 9-11. The pallet 102 of FIGS. 9-11 is configured to use the feet 20 of FIGS. 5-8. The pallet 102 has a first corrugated sheet 104 comprising a top surface 106 having a length and a width, and a corresponding a bottom surface 108. A plurality of first apertures 110 extend through the top surface 106 to the bottom surface 108. Four side flaps 130 are located along each side of the length and width of the first corrugated sheet 104, with each side flap 130 including a top score 132 located at a junction between the top surface 108 and the side flap 130 and extending the length or width of the top surface 130. A bottom score 134 is located outwardly from and parallel to the top score 132, and a securing flap portion 136 is located outwardly of the bottom score 134. A plurality of feet 20 are provided as separate molded components. The second corrugated sheet 112 has a top surface 114 having a length and a width, a corresponding a bottom surface 116, and a plurality of second apertures 118 extending through the top surface 114 to the bottom surface 116. As shown in FIGS. 9 and 10, the second corrugated sheet 112 is placed over the plurality of feet 20 such that each of the outer side foot surface 54 and the outer foot bottom 24 of each of the plurality of feet 20 extend through the plurality of second apertures 118 in the second corrugated sheet 112.

The planar top surfaces 48 of each of the plurality of feet 20 engage the bottom surface 108 of the first corrugated sheet 104 such that each of the first apertures 110 of the first corrugated sheet 104 corresponds to the opening 26 of the cavity 22 for one of the plurality of feet 20. Also, the second corrugated sheet 112 engages the planar planar extension or extensions 42 of each of the respective plurality of feet 20 such that each outer foot bottom 24 is spaced from the second corrugated sheet 112. As shown in FIGS. 9 and 10, the side flaps 130 are bent at least ninety degrees from parallel along the top scores 132 and also bent along the bottom scores 134 to define side surfaces 140 of pallet 102. The respective securing flap portions 136 attach to the bottom surface 116 of the second corrugated sheet 112 in the same manner as shown in FIG. 1 to secure the plurality of feet 20 between the first corrugated sheet 104 and the second corrugated sheet 112 to form the pallet 102.

The plurality of feet 20 may float freely between the first corrugated sheet 104 and the second corrugated sheet 112. In other embodiments, the plurality of feet 20 are adhered to the bottom surface 108 of the first corrugated sheet 104. The plurality of feet may further include at least three downwardly and outwardly extending protrusions 44, and the plurality of apertures 118 in the second corrugated sheet 112 are shaped such that the downwardly and outwardly extending protrusions 44 of the plurality of feet extend 20 through the plurality of apertures 118 in the second corrugated sheet 112. The plurality of first apertures 110 of the first corrugated sheet 104 may have a shape and size substantially the same as said plurality of feet 20 so as to accept feet 20 from an adjacent pallet 102 in a nesting fashion as shown in FIG. 11. The size and shape of the opening 26 of the cavity 22 in each of the respective plurality of feet 20 may match a size and shape of the plurality of apertures 110 in the first corrugated sheet 104. In other embodiments, the size and shape of the opening 26 of the cavity 22 in each of the respective plurality of feet 20 is greater than a size and shape of the plurality of apertures 110 in the first corrugated sheet 104.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pallet comprising:

a first corrugated sheet comprising a top surface having a length and a width, a corresponding a bottom surface, a plurality of first apertures extending through the top surface to the bottom surface, four side flaps located along each side of the length and width of the first corrugated sheet, each side flap including a top score located at a junction between the top surface and the side flap, a bottom score located outwardly from and parallel to the top score, and a securing flap portion located outwardly of the bottom score;

a plurality of feet provided as separate molded components, the plurality of feet having a planar top surface with a cavity and an opposing planar bottom surface, the cavity having an opening, the cavity extending to the bottom surface;

a second corrugated sheet comprising a top surface having a length and a width, a corresponding a bottom surface, and a plurality of second apertures extending through the top surface to the bottom surface;

wherein the planar top surfaces of each of the plurality of feet engage the bottom surface of the first corrugated sheet such that each of the first apertures of the first corrugated sheet corresponds to the opening of a cavity for one of the plurality of feet;

wherein the second corrugated sheet is placed over the plurality of feet such that each of the bottom surfaces of each of the plurality of feet extend through the plurality of second apertures in the second corrugated sheet and the top surface of the second corrugated sheet engages the planar bottom surface of each of the respective plurality of feet such that each of the bottom surfaces of each of the plurality of feet is spaced from the second corrugated sheet;

wherein the side flaps are bent at least ninety degrees from parallel along the top scores and also bent along the bottom scores to define side surfaces of pallet and such that the respective securing flap portions attach to the bottom surface to the second corrugated sheet to secure the plurality of feet between the first corrugated sheet and the second corrugated sheet to form the pallet; and wherein the plurality of first apertures of the first corrugated sheet have a shape and size substantially the same as said plurality of feet so as to accept a foot from an adjacent pallet in a nesting fashion; and wherein a size and shape of the opening of the cavity in each of the respective plurality of feet is greater than a size and shape of the plurality of apertures in the first corrugated sheet.

2. The pallet of claim 1 wherein each of the side flaps tapers inwardly from the first top score at each of a first end and second end of the respective side flaps.

3. The pallet of claim 1 wherein the securing flap portions attach to the bottom surface of the second corrugated sheet through an adhesive substance.

4. The pallet of claim 3 wherein the adhesive substance is selected from one of: animal glue, casein glue, serum albumen glue, starch glue, dextrin glue, agar, algin, gum arabic, nitrocellulose resin, polyvinyl acetate resin, vinyl acetate-ethylene copolymer resin, polyethylene resin, polypropylene resin, polyamide resin, polyester resin, acrylic resin, cyanoacrylic resin, phenol formaldehyde, urea formaldehyde, unsaturated polyesters, epoxy, and polyurethane, natural rubber, butyl rubber, butadiene rubber, styrene-butadiene rubber, nitrile rubber, silicone, and neoprene.

5. The pallet of claim 1, wherein the first corrugated sheet comprises double-lined corrugated paperboard or corrugated plastic board.

6. The pallet of claim 1, wherein each of said plurality of feet is formed into a frustoconical shape.

7. The pallet of claim 1, wherein each of the plurality of feet is formed into a cylindrical shape.

8. The pallet of claim 1, wherein each of the plurality of feet is formed into a bilobal or multifoil column.

9. The pallet of claim 1, wherein the plurality of feet float freely between the first corrugated sheet and the second corrugated sheet.

10. The pallet of claim 1, wherein the plurality of feet are adhered to the bottom surface of the first corrugated sheet at the planar top surfaces of each of the plurality of feet.

11. The pallet of claim 1, wherein the plurality of feet further include at least three downwardly and outwardly extending protrusions from the opening and the side surfaces, and wherein the plurality of apertures in the second corrugated sheet are shaped such that the downwardly ad outwardly extending protrusions of the plurality of feet extend through the plurality of apertures in the second corrugated sheet.

12. A pallet comprising:

a first corrugated sheet having a top surface, a corresponding a bottom surface, and a plurality of first apertures extending through the top surface to the bottom surface;

a second corrugated sheet having a top surface, a corresponding a bottom surface, and a plurality of second apertures extending through the top surface to the bottom surface; and a plurality of feet provided as separate components, the plurality of feet having a cavity and a bottom surface, the cavity having an opening extending to the bottom surface;

wherein the plurality of feet engage the bottom surface of the first corrugated sheet such that each of the first apertures of the first corrugated sheet corresponds to the opening of a cavity for one of the plurality of feet;

wherein the second corrugated sheet is placed over the plurality of feet such that each of the plurality of feet extend through the plurality of second apertures in the second corrugated sheet with each bottom surface spaced from the second corrugated sheet;

wherein the first corrugated sheet is attached to the second corrugated sheet to secure the plurality of feet between the first corrugated sheet and the second corrugated sheet to form the pallet; and wherein the plurality of first apertures of the first corrugated sheet have a shape and size substantially the same as said plurality of feet so as to accept a foot from an adjacent pallet in a nesting fashion; and wherein a size and shape of the opening of the cavity in each of the respective plurality of feet is greater than a size and shape of the plurality of apertures in the first corrugated sheet.

13. The pallet of claim 12 wherein the first corrugated sheet is cardboard and includes at least one flap configured to be attached to the bottom surface of the second corrugated sheet to secure the plurality of feet between the first corrugated sheet and the second corrugated sheet.

14. The pallet of claim 13 wherein the first corrugated sheet is a quadrilateral and includes four flaps located along each side of the first corrugated sheet, each flap including a top score located at a junction between the top surface and the side flap, a bottom score located outwardly from and parallel to the top score, and a securing flap portion located outwardly of the bottom score, wherein each of the flaps tapers inwardly from a first top score at each of a first end and second end of the respective side flaps, and wherein the flaps are bent at least ninety degrees from parallel along the top scores and also bent along the bottom scores to define side surfaces of pallet and such that the respective securing flap portions attach to the bottom surface to the second corrugated sheet to secure the plurality of feet between the first corrugated sheet and the second corrugated sheet.

15. The pallet of claim 14 wherein the securing flap portions attach to the bottom surface of the second corrugated sheet through an adhesive substance selected from one of: animal glue, casein glue, serum albumen glue, starch glue, dextrin glue, agar, algin, gum arabic, nitrocellulose resin, polyvinyl acetate resin, vinyl acetate-ethylene copolymer resin, polyethylene resin, polypropylene resin, polyamide resin, polyester resin, acrylic resin, cyanoacrylic resin, phenol formaldehyde, urea formaldehyde, unsaturated polyesters, epoxy, and polyurethane, natural rubber, butyl rubber, butadiene rubber, styrene-butadiene rubber, nitrile rubber, silicone, and neoprene, and wherein the first corrugated sheet and the second corrugated sheet comprises double-lined corrugated paperboard.

16. The pallet of claim 14 wherein the securing flap portions attach to the bottom surface of the second corrugated sheet with staples.

17. The pallet of claim 12 wherein the first corrugated sheet is plastic and is secured to the second corrugated sheet to secure the plurality of feet between the first corrugated sheet and the second corrugated sheet.

18. The pallet of claim 17 wherein the first corrugated sheet and the second corrugated sheet are plastic, and the first corrugated sheet is secured to the second corrugated sheet along a score line, and the first corrugated sheet is folded onto the top of the second corrugated sheet along the score line to secure the plurality of feet between the first corrugated sheet and the second corrugated sheet.

19. The pallet of claim 17, wherein the first corrugated sheet and the second corrugated sheet are plastic, and the first corrugated sheet is secured to the second corrugated sheet though heat sealing or sonic welding.

20. The pallet of claim 12 wherein the each of the plurality of feet is formed into one of: a frustoconical shape, a cylindrical shape, a bilobal columnar shape, or a multifoil columnar shape.

21. The pallet of claim 20 wherein the plurality of feet are constructed from plastic.

22. The pallet of claim 18 wherein the each of the plurality of feet is formed into one of: a frustoconical shape, a cylindrical shape, a bilobal columnar shape, or a multifoil columnar shape.

23. The pallet of claim 22 wherein the plurality of feet are constructed from plastic.

* * * * *